US005622238A

United States Patent [19]

Farmer

[11] Patent Number: 5,622,238

[45] Date of Patent: Apr. 22, 1997

[54] RETRACTABLE AND LOCKABLE LADDER STABILIZER

[76] Inventor: Richard M. Farmer, 432 Granville Ct., NE., Atlanta, Ga. 30328

[21] Appl. No.: 527,342

[22] Filed: Sep. 12, 1995

[51] Int. Cl.[6] ..... E06C 7/14

[52] U.S. Cl. ..... 182/214; 182/107

[58] Field of Search ..... 182/214, 229, 182/107, 116, 187

[56] References Cited

U.S. PATENT DOCUMENTS

| | | | |
|---|---|---|---|
| 662,566 | 11/1900 | Jones . | |
| 1,015,122 | 1/1912 | Bauer . | |
| 1,593,366 | 7/1926 | Singer | 182/107 X |
| 2,307,543 | 1/1943 | Reed . | |
| 2,808,975 | 10/1957 | Palmquist . | |
| 2,870,948 | 1/1959 | Lundgren . | |
| 3,703,939 | 11/1972 | Maxwell | 182/214 X |
| 3,715,012 | 2/1973 | Perry . | |
| 4,121,692 | 10/1978 | Morawski . | |
| 4,593,790 | 6/1986 | Brewer et al. . | |
| 4,643,274 | 2/1987 | Tataseo . | |
| 4,787,476 | 11/1988 | Lee . | |
| 5,012,895 | 5/1991 | Santos . | |
| 5,242,031 | 9/1993 | Ashley | 182/214 |
| 5,279,390 | 1/1994 | Phillips . | |
| 5,460,241 | 10/1995 | LaBelle | 182/214 |

FOREIGN PATENT DOCUMENTS

| | | | |
|---|---|---|---|
| 2629861 | 10/1989 | France | 182/107 |
| 613268 | 12/1960 | Italy | 182/107 |

*Primary Examiner*—Alvin C. Chin-Shue
*Attorney, Agent, or Firm*—Needle & Rosenberg, P.C.

[57] ABSTRACT

A device for stabilizing a ladder for supporting it against an upright surface has an L-shaped member having a horizontally extending plate terminating in a downwardly depending section and a means for detachably securing the downwardly depending section to the upper end of the ladder. A second plate, hingedly attached to the L-shaped member, is movable between an operative position and an inoperative position. When in the operative position, the stabilizer is adapted to rest against the upright surface thereby preventing the ladder from tipping. When in the inoperative position, the second plate is parallel to the downwardly depending section of the L-shaped member. A locking means locks the second plate in the operative position, and spring maintains the second plate in the inoperative position when the stabilizer is not in use.

17 Claims, 4 Drawing Sheets

RETRACTABLE AND LOCKABLE LADDER STABILIZER

BACKGROUND OF THE INVENTION

1. Field of the Invention

The present invention relates in general to ladder stabilizers and in particular to a stabilizing attachment to a ladder that can be locked into place when in use and retracted when not in use.

2. The Prior Art

Various forms of ladder stabilizers have long been known to the art of safety product design. U.S. Pat. No. 2,808,97, issued to Palmquist, shows a relatively flat ladder plate to which two inverted L-shaped bracket members are welded or otherwise secured. The bracket members extend upwardly on the rear of the plate, thence rearwardly therefrom at an obtuse angle. A pole plate is secured on the rearwardly extending portions of the bracket members by means of upwardly projecting, threaded studs.

U.S. Pat. No. 3,715,012, issued to Perry, discloses a ladder safety brace.

U.S. Pat. No. 4,643,274, issued to Tataseo, discloses a ladder stand-off device for supporting the upper end of a ladder in spaced relationship with a wall against which the ladder is leaned.

U.S. Pat. No. 662,566, issued to Jones, discloses portable staging attached to ladders. U.S. Pat. No. 1,015,123, issued to Bauer, discloses a ladder having two spaced supports.

U.S. Pat. No. 4,593,790, issued to Brewer et al., discloses a ladder stabilizer.

U.S. Pat. No. 5,012,895, issued to Santos, discloses a ladder stabilizer comprising top extension arms and attached stabilizer bars.

U.S. Pat. No. 4,787,476, issued to Lee, and U.S. Pat. No. 5,279,390, issued Phillips, disclose tree stands.

U.S. Pat. No. 2,870,948, issued to Lundgren, discloses a ladder attachment used to secure the upper end of a ladder to any elongated object.

The R. D. Werner Co., Inc. Ladders Catalog of April 1993, p. 22, discloses an adjustable pole lash.

The disadvantages of the prior art include that there is no selectively deployable stabilizer for a ladder that can be both deployed and secured quickly. Nor is there any mechanism for holding the stabilizer in a secured position until it has been positively deployed, thereby preventing the user from mistakenly believing the stabilizer is deployed. Nor do any of the prior art devices disclose a means for adapting a stabilizer to surfaces of varying angles.

SUMMARY OF THE INVENTION

The disadvantages of the prior art are overcome by the present invention, namely, a stabilizer for a ladder. The stabilizer is used in connection with a conventional ladder having two longitudinally spaced apart ladder rails, a lower end and an upper end, with the lower end of the ladder capable of resting on a ground surface and the upper end of ladder capable of resting against an upright surface. The stabilizer device comprises an L-shaped member having a horizontally extending plate terminating in a downwardly depending section. A means for detachably securing the downwardly depending section to the upper end of the ladder attaches the device to the ladder. A second plate is attached to the L-shaped member by a hinge. The second plate has a top surface, an opposed bottom surface, a first edge and a second edge. The second plate is movable between an operative position, wherein the first edge is adapted to rest against the upright surface thereby preventing the ladder from tipping, and an inoperative position, whereby the bottom surface is parallel to the downwardly depending section of the L-shaped member.

A locking means holds the second plate in the operative position when the device is in use. A means for maintaining the second plate in the inoperative position (such as a spring having a first end attached to the second plate and a second end attached to the L-shaped member adapted to put a force on the second plate in the direction of the inoperative position) holds the second plate parallel to the ladder while the device is not in use. This feature ensures that the device will not be deployed unless the second plate is locked in the operative position. This feature also ensures that the second plate will not swing away from the ladder when the ladder is being transported.

In one preferred embodiment, the downwardly depending member depends from the horizontally extending plate of the L-shaped member at a first predetermined angle. When the second plate is then engaged in the operative position, with the first edge resting against the upright surface and the second plate being horizontal, the base of the ladder is held at a second predetermined angle relative to a horizontal surface, such as the ground. If the second predetermined angle is 75.5 degrees, then the ladder is automatically held at the OSHA standard.

Another preferred embodiment employs a means for moving the second plate to the operative position from a remote location. This would enable the user, from the base of the ladder, to pull down the first edge toward the L-shaped member and engage the locking means, thereby positively deploying the second plate in the operative position.

The second plate has two spaced-apart extensions extending outwardly therefrom, each terminating in a distal end. First and second articulating feet, each having a contacting surface, are each pivotally attached to a respective one of the distal ends. The contacting surface of the first articulating foot is adapted to engage a first respective portion of the upright surface, and the contacting surface of the second articulating foot is adapted to engage a second respective portion of the upright surface. This allows the device to be placed against an upright surface when the first portion of the upright surface is angularly divergent from the second portion of the upright surface (such as an inside or outside corner). The device may also be used when the first and second portions of the upright surface are parallel (such as with a flat wall).

The device has a means for holding the device against a pole which comprises a flexible means secured at one end to the second plate and extending around the circumference of the pole (such as a strap or a chain) and a means for attaching the second end to the second plate. A means for ratcheting the flexible means may be used to secure the flexible means tightly around the pole. Alternatively, the flexible means may be secured to the pole by a means for releasably clamping the flexible means, such as a cam-type over-center locking device.

The second plate has two extensions extending outwardly therefrom defining a V-shaped opening therebetween. Each of the extensions has an inside edge which engages the circumference of a pole. Plates having a serrated surface may be removably attached to a portion of the inside edge.

The inside edge could alternatively comprise a slip-resistant surface or a padded surface.

The device may be adapted for use with retractable extension ladders having a first ladder portion, with a first set of longitudinally spaced-apart rails, and a second ladder portion substantially parallel to the first ladder portion, with a second set of longitudinally spaced-apart rails and a top end. For such use, with the L-shaped member secured to the first ladder portion, the horizontal plate extends away from the first ladder portion so that the second plate and the first ladder portion form a channel therebetween sufficient to receive therein the top end of the second ladder portion when the second plate is in the inoperative position. This feature keeps the second plate, when in the inoperative position, from blocking the second ladder portion, thus allowing the ladder to be almost completely retracted when the stabilizer is not in use.

It is an object of the present invention to stabilize a ladder with a stabilizer that can be both deployed and secured quickly.

It is a further object of the present invention to hold a ladder stabilizer in a secured position until it has been positively deployed, thereby preventing the user from mistakenly believing the stabilizer is deployed.

It is a further object of the present invention to hold a ladder to a pole with a stabilizer having a rachetable pole strap that can be fitted with an extension, for use with large diameter poles, or a chain, for use with abrasive surfaces.

It is a further object of the present invention to adapt a stabilizer for stabilizing a ladder so that the ladder can be placed against surfaces of varying angles.

These and other objects of the present invention will be disclosed fully in the detailed description that follows.

DETAILED DESCRIPTION

Figure 1A:
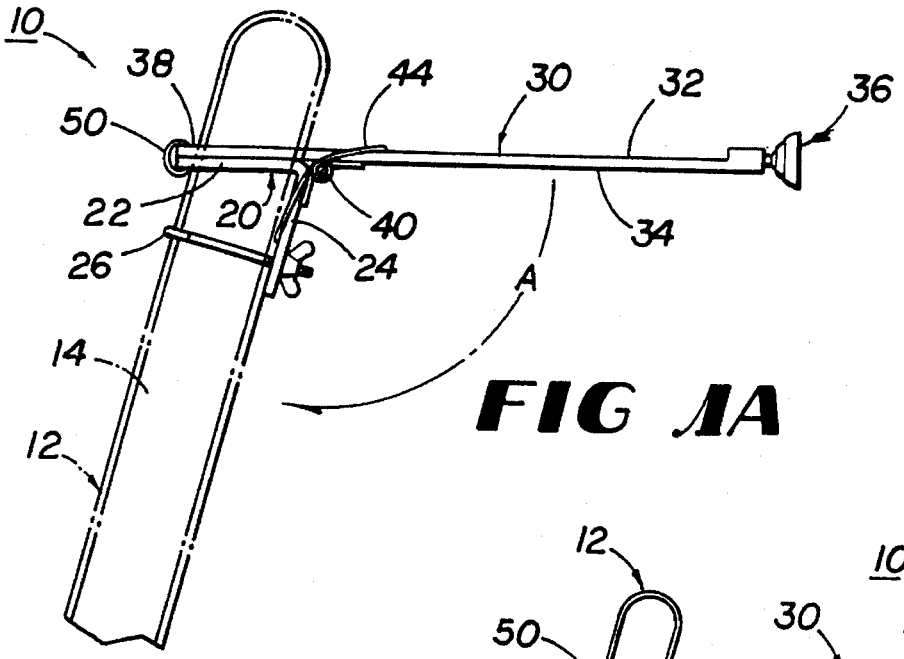
FIG. 1*a* is a side elevational view of the present invention in the deployed position.

The invention is now described in detail. Referring to the drawings, like numbers indicate like parts throughout the views.

Figure 1B:
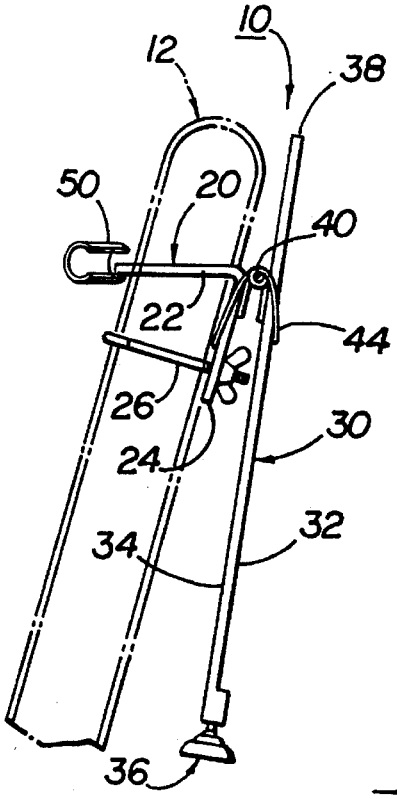
FIG. 1*b* is a side elevational view of the present invention in the non-deployed position.

As shown in FIGS. 1*a* and 1*b*, the present invention 10 is a stabilizer device for supporting a ladder 12 as it rests against an upright surface. The device comprises an L-shaped member 20 having a horizontally extending plate 22 with a section 24 depending downwardly therefrom. The downwardly depending section 24 is secured to the ladder 12 using any suitable securing means 26 of the type obvious to one skilled in the art (e.g., J-bolts and wing nuts). A second plate 30 is attached to the L-shaped member 20 with a hinge 40. The second plate has a top surface 32, an opposite bottom surface 34, a first edge 36 and a second edge 38.

The second plate 30 may be moved between an operative position, as shown in FIG. 1*a*, and an inoperative position, as shown in FIG. 1*b*. When the stabilizer 10 is not in use, the second plate 30 is held in the inoperative position by a means 44 for maintaining the position of the second plate 30, such as a spring. When the second plate 30 is in the operative position, the first edge 36 is adapted to rest against the upright surface, thereby providing support for the ladder 12.

FIGS. 1*a* and 1*b* also show the interaction of the locking means 50 and the maintaining means 44. (As shown here, the maintaining means 44 is a spring. However, as would be obvious to one skilled in the art, other suitable mechanisms could be employed to maintain the second plate 30 in the inoperative position). As shown in FIG. 1*a*, when the locking means 50 engages the second edge 38 of the second plate 30 and the horizontal plate 22, the second plate 30 is held in the operative position and the maintaining means 44, which is attached to the downwardly depending section 24 at one end and the second plate 30 at the other end, puts a downward force in the direction of arrow A on the second plate 30. As shown in FIG. 1*b*, when the locking means 50 is disengaged from the second plate 30, the maintaining means 44 forces the second plate 30 against the downwardly depending section 24. This prevents users from mistakenly thinking that the locking means 50 is engaged when it is not, and it also prevents the second plate 30 from swinging out during transportation.

Figure 2:
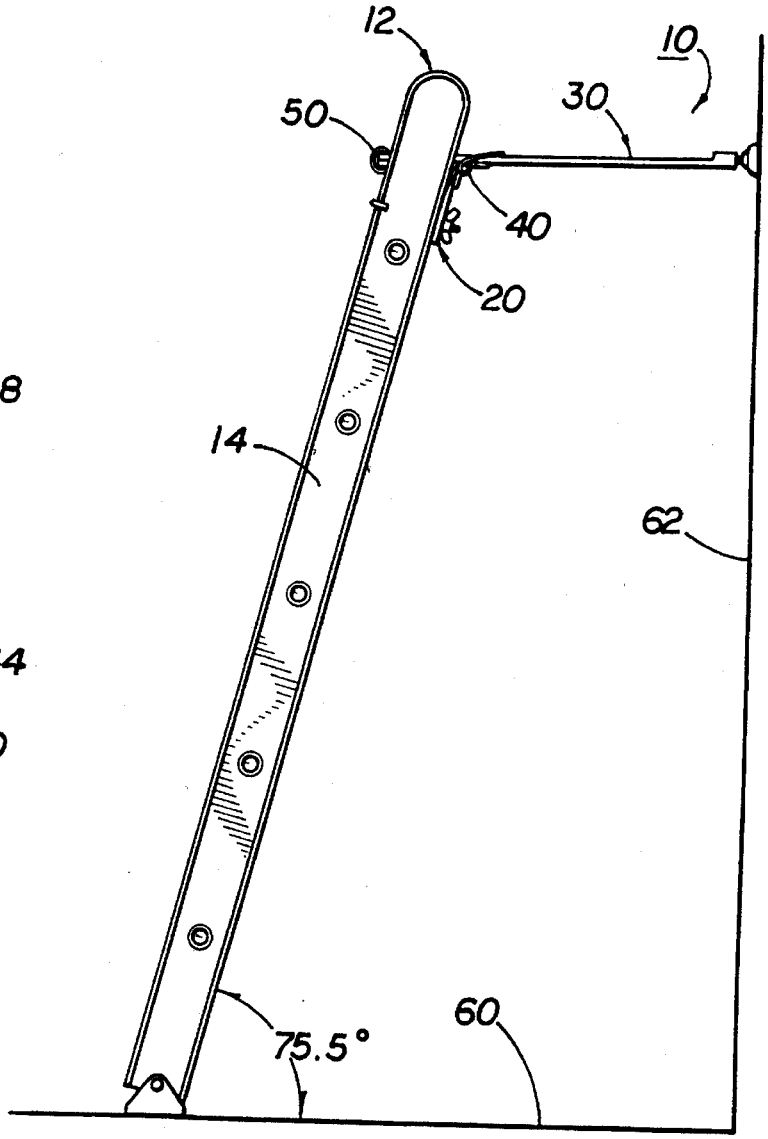
FIG. 2 is a side perspective view of the present invention secured to a ladder resting on a horizontal surface and against an upright surface.

As shown in FIG. 2, when the second plate 30 is in the operative position and is rested against an upright surface 62 so that the second plate is substantially horizontal, the rails 14 of the ladder 12 are held at a predetermined angle from a horizontal ground surface 60. This angle is preferably 75.5°, as that is the OSHA standard.

Figure 3A:
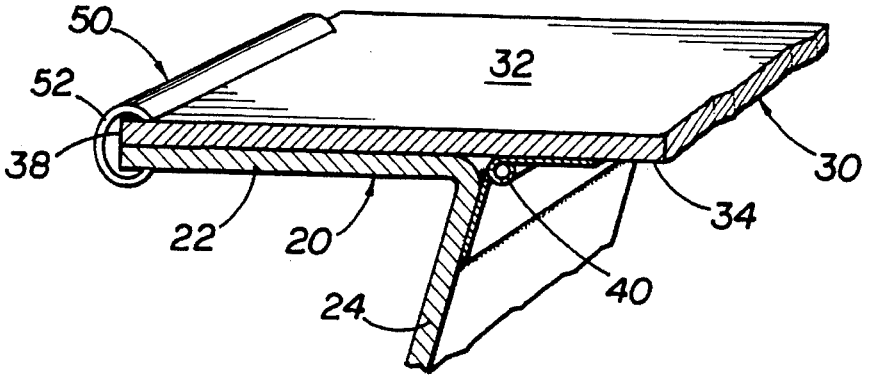
FIG. 3*a* is a side perspective detail of a first embodiment of the locking means for the device.

As shown in FIG. 3*a*, a locking means 50 holds the second plate 30 in the operative position. Any suitable locking means 50 may be used to hold the second plate 30 in the operative position, including a tubular squeeze-action clamp 52. The tubular squeeze-action clamp 52 is inexpensive and easy to manufacture, as is can be made from a section of metal tubing with a passage cut along its length. The width of the passage would be slightly greater than the width of the horizontal plate 22 and the second plate 30 when placed against each other.

Figure 3B:
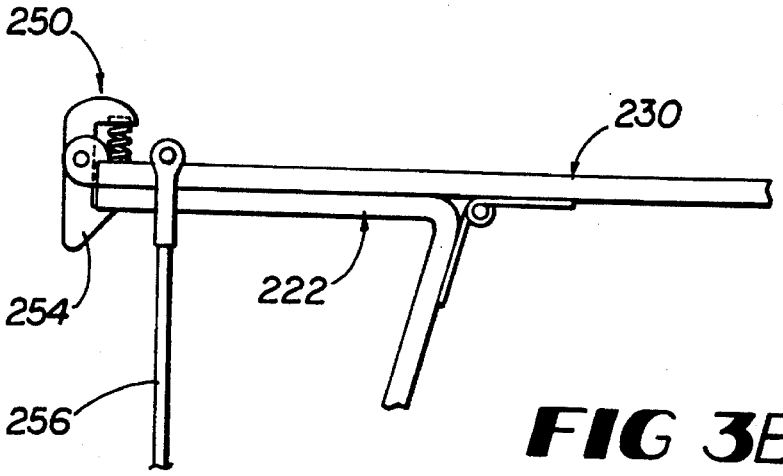
FIG. 3*b* is a side elevational detail of a second embodiment of the locking means for the device.

FIG. 3*b* shows an alternative embodiment of the locking means, wherein the locking means 250 is a spring-action toggle catch 254. This embodiment has the advantage of allowing for deployment of the second plate 230 from a remote location such as the base of the ladder. To enable such deployment, a line 256 is attached to the second plate 230 so that when the line 256 is pulled down, the second plate 230 is pulled down against the horizontal plate 222, causing the toggle catch 254 to engage the horizontal plate 222, thereby holding the second plate 230 in the operative position.

Figure 4A:
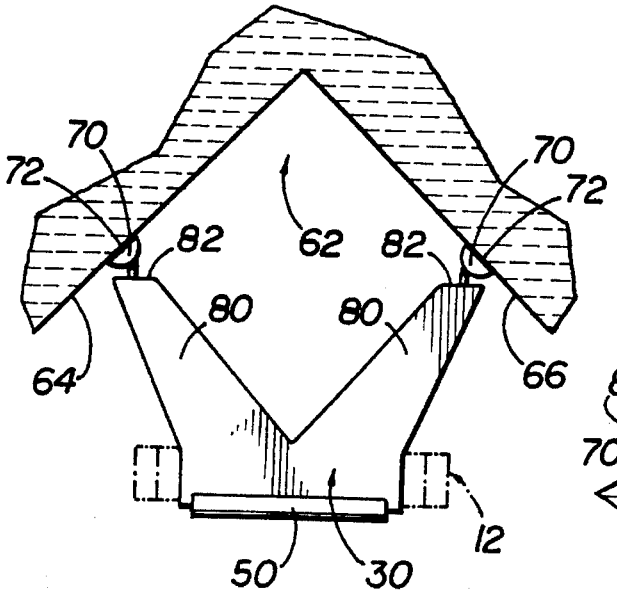
FIG. 4*a* is a top plan view of the present invention resting against an inside corner.
Figure 4B:
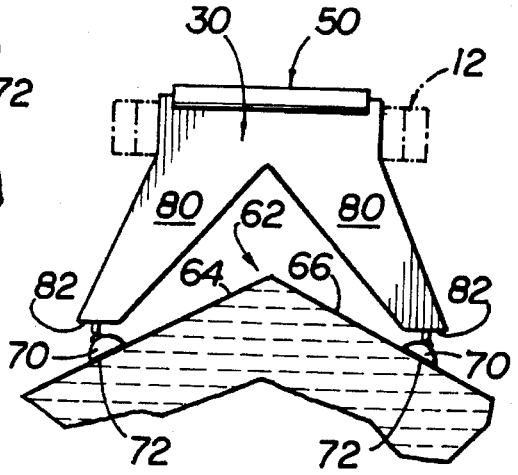
FIG. 4*b* is a top plan view of the present invention resting against an outside corner.

As shown in FIGS. 4*a* and 4*b*, the present invention can be used against both inside and outside corners of an upright surface. The second plate 30 has two spaced-apart extensions 80, each having a distal end 82. Pivotally attached to each distal end 82 is an articulating foot 70 having a contacting surface 72. If the upright surface 62 has a first surface portion 64 and a second surface portion 66, the two surface portions being angularly divergent (as is the case with an inside comer shown in FIG. 5*a* and an outside comer shown in FIG. 5*b*), the articulating feet 70 will pivot so that each contacting surface 72 will be juxtaposed with its respective surface portion 64 & 66. As is obvious, the articulating feet 70 will work equally well with a single flat upright surface 62.

Figure 5A:
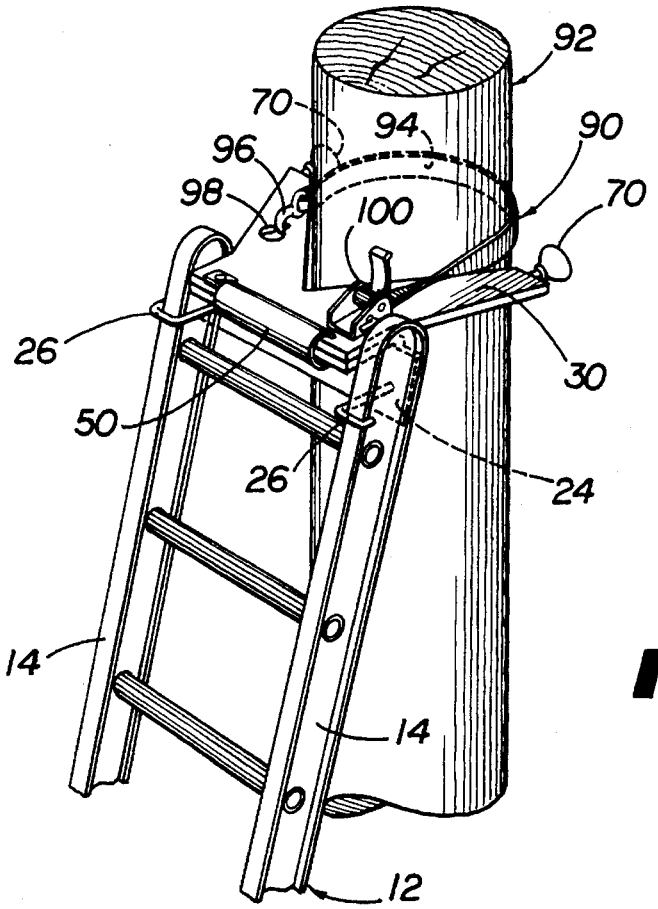
FIG. 5*a* is a perspective view of the present invention resting against a pole.

As shown in FIG. 5*a*, means 90 are provided for holding the ladder 12 against a pole 92. Such means 90 comprise a flexible means 94 (such as a strap, a chain or a cable) for securing the second plate 30 to the pole. By placing a holding means 90 at the top, the ladder 12 is held securely to the pole 92 with no chance of pivoting.

Figure 5B:
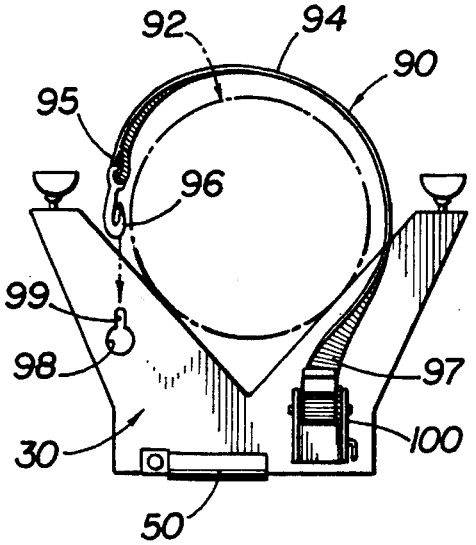
FIG. 5*b* is a top plan view of the present invention showing a first embodiment of the flexible holding means.

In one preferred embodiment shown in FIG. 5*b*, the flexible means 94 is a strap having a first end 97 affixed to a racheting mechanism 100. The racheting mechanism 100 is, in turn, attached to the second plate 30. The racheting mechanism 100 may be permanently attached to the second plate 30, or it may be removably attached with, for example, a cotter pin (not shown). The second end of the strap 95 terminates with a metal hook 96. When the flexible means 94 is wrapped around a pole, the hook 96 engages a hole 98 in the plate 30 and the racheting mechanism 100 can then be used to tighten the flexible means 94 around the pole.

The hole 98 may be "key-hole" shaped, with a narrow portion 99, so that the flexible means 94 may be a strap extended with a chain (not shown). The hook 96 is hooked onto one end of the chain, with the other end of the chain being received by the hole 98 and engaging the second plate 30 by being held in the narrow portion 99.

Figure 5C:
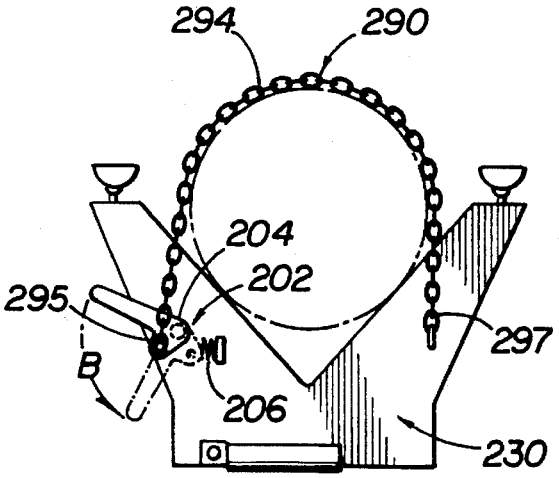
FIG. 5*c* is a top plan view of the present invention showing a second embodiment of the flexible holding means.

In an alternative preferred embodiment, as shown in FIG. 5*c*, the entire flexible means 294 may be a chain affixed at a first end 297 to the second plate 230. A clamping means 202 is used to tighten the flexible means 294 around the pole 292. The clamping means 202 may comprise an over-center locking device 204 pulled in the direction of arrow B by a spring 206. To tighten the flexible means, the second end 295 of the flexible means 294 is engaged with the over-center locking device 204 and the over-center locking device is moved in the direction of arrow B, being held by the spring 206.

Figure 6:
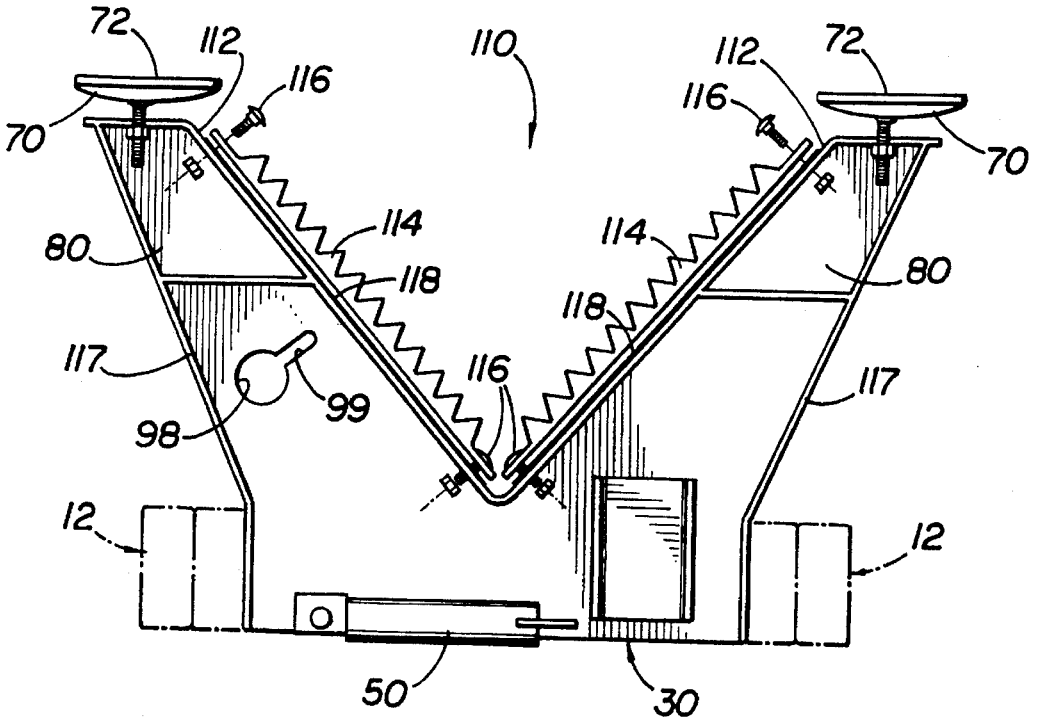
FIG. 6 is a top plan view, with certain parts exploded away for clarity, of another embodiment of the present invention showing removable serrated plates.

As shown in FIG. 6, the second plate 30 can be adapted in several ways to engage different types of poles. A V-shaped opening 110 is formed by two spaced-apart extensions 80 extending from the second plate 30. The opening 110 has in inside edge 112 adapted to receive serrated plates 114, which may be removably attached to the inside edge 112 with bolts 116. Such serrated plates 114 provide positive engagement of the second plate 30 with wooden poles, trees and other similar poles. During transportation of the ladder, each of the plates 114 may be covered with a plastic tube, slit along one side, to protect the serrations.

For use with more rigid poles, the plates 114 may be removed to expose the inside edge 112. The inside edge 112 may be left bare or covered with an application-specific surface 118, such as a slip-resistant material, padding, or any type of material suited to a specific type of pole.

Also shown in FIG. 6, the second plate 30 may have a structural lip 117 that provides added strength to the second plate 30. The structural lip 117 also prevents objects from rolling off of the second plate 30, thereby providing a convenient work surface for the placement of tools, paint cans, and the like.

Figure 7:
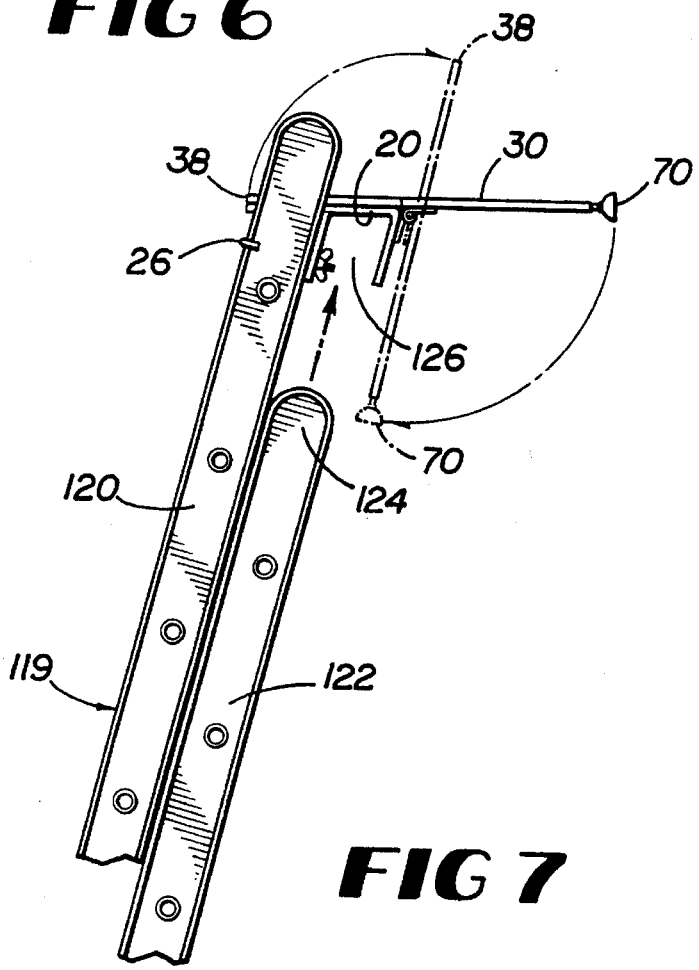
FIG. 7 is a side elevational view of the present invention adapted for use with a retractable extension ladder.

As shown in FIG. 7, the present invention 10 may be adapted for use with a retractable extension ladder 119 having a first ladder portion 120 and a second ladder portion 122 with a top end 124. In order to allow the second ladder portion 122 to be able to retract without being blocked by the second plate 30, the horizontal plate 20 must be extended so that a channel 126 is formed between the first ladder portion 120 and the second plate 30 when the second plate 30 is in the inoperative position. With such a channel 126, the second ladder portion 122 may be slid upward, with the top end 124 fitting between the first ladder portion 120 and the second plate 30.

The above describe embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A device for stabilizing a ladder, the ladder having two longitudinally spaced apart ladder rails, a lower end and an upper end, the lower end of the ladder capable of resting on a ground surface and the upper end of ladder capable of resting against an upright surface, the device comprising:

a. an L-shaped member having a horizontally extending plate terminating in a downwardly depending section;

b. means for detachably securing the downwardly depending section to the upper end of the ladder;

c. a second plate, hingedly attached to the L-shaped member and having a top surface, an opposed bottom surface, a first edge and a second edge, the second plate being movable between an operative position, wherein the first edge is adapted to rest against the upright surface thereby preventing the ladder from tipping, and an inoperative position, whereby the bottom surface is parallel to the downwardly depending section of the L-shaped member, the horizontally extending plate of the L-shaped member disposed so as to stop movement of the first edge of the second plate, thereby preventing the second plate from extending above the operative position;

d. means for locking the second plate in the operative position; and means for maintaining the second plate in the inoperative position,unless the second plate is locked in the operative position.

2. The device of claim 1, wherein the downwardly depending member depends from the horizontally extending plate of the L-shaped member at a first predetermined angle so that when the second plate is engaged in the operative position with the first edge resting against the upright surface and the second plate being horizontal, the ladder is held at a second predetermined angle relative to a horizontal surface.

3. The device of claim 2, wherein the second predetermined angle is 75.5 degrees.

4. The device of claim 1 further comprising means for moving the second plate to the operative position from a remote location, so that the first edge is pulled down toward the L-shaped member and engages the locking means, thereby positively deploying the second plate in the operative position.

5. The device of claim 1, wherein the second plate has two spaced-apart extensions extending outwardly therefrom, each terminating in a distal end, further comprising:

a first articulating foot and a second articulating foot, each articulating foot having a contacting surface and each pivotally attached to one of the distal ends so that the contacting surface of the first articulating foot is adapted to engage a first respective portion of the upright surface and the contacting surface of the second articulating foot is adapted to engage a second respective portion of the upright surface.

6. The device of claim 5 wherein the first articulating foot and the second articulating foot comprise means for pivoting relative to a distal end so that the contacting surfaces are capable of engaging an upright surface when the first portion of the upright surface is angularly divergent from the second portion of the upright surface.

7. The device of claim 5 wherein the first articulating foot and the second articulating foot comprise means for pivoting relative to a distal end so that the contacting surfaces are capable of engaging an upright surface when the first portion of the upright surface is parallel to the second portion of the upright surface.

8. The device of claim 1 further comprising means for holding the device against a pole.

9. The device of claim 8, wherein the holding means comprises:

a. flexible means secured at one end to the second plate and extending around the circumference of the pole; and b. means for attaching the second end to the second plate.

10. The device of claim 9 further comprising means for ratcheting the flexible means thereby securing the flexible means tightly around the pole.

11. The device of claim 9 further comprising means for releasably clamping the flexible means thereby securing the flexible means tightly around the pole.

12. The device of claim 1, wherein the second plate has two extensions extending outwardly therefrom, defining a V-shaped opening therebetween, each of the extensions having an inside edge that is adapted to engage a circumference of a pole.

13. The device of claim 12, further comprising serrated plates removably attached to and disposed along a portion of the inside edge, the plates having a serrated surface for engaging wooden poles.

14. The device of claim 12, wherein the inside edge comprises a slip-resistant surface.

15. The device of claim 12, wherein the inside edge comprises a padded surface.

16. The device of claim 1 wherein the ladder has a first ladder portion having a first set of longitudinally spaced-apart rails and a second ladder portion substantially parallel to the first ladder portion and having a second set of longitudinally spaced-apart rails and a top end, the L-shaped member being secured to the first ladder portion, wherein the second plate and the first ladder portion form a channel therebetween sufficient to receive therein the top end of the second ladder portion when the second plate is in the inoperative position.

17. A device for stabilizing a ladder, the ladder having two longitudinally spaced apart ladder rails, a lower end and an upper end, the lower end of the ladder capable of resting on a ground surface and the upper end of ladder capable of resting against an upright surface, the device comprising:

a. an L-shaped member having a horizontally extending plate terminating in a downwardly depending section;

b. means for detachably securing the downwardly depending section to the upper end of the ladder;

c. a second plate, hingedly attached to the L-shaped member and having a top surface, an opposed bottom surface, a first edge and a second edge, the second plate being movable between an operative position, wherein the first edge is adapted to rest against the upright surface thereby preventing the ladder from tipping, and an inoperative position, whereby the bottom surface is parallel to the downwardly depending section of the L-shaped member;

d. a spring, for locking the second plate in an inoperative position, having a first end attached to the second plate and a second end attached to the L-shaped member adapted to put a force on the second plate in the direction of the inoperative position; and e. means for maintaining the second plate in the inoperative position.

* * * * *